United States Patent [19]

Dilouya

[11] Patent Number: 4,823,246

[45] Date of Patent: Apr. 18, 1989

[54] SHALLOW INDICATOR LIGHT FOR A MOTOR VEHICLE

[75] Inventor: Gilbert Dilouya, Paris, France

[73] Assignee: Cibie Projecteurs, Bobigny Cedex, France

[21] Appl. No.: 137,455

[22] Filed: Dec. 23, 1987

[30] Foreign Application Priority Data

Dec. 23, 1986 [FR] France ..... 86 18038

[51] Int. Cl.[4] ..... F21V 13/04

[52] U.S. Cl. ..... 362/328; 362/296; 362/297; 362/299; 362/336; 362/337; 362/339

[58] Field of Search ..... 362/326, 327, 328, 339, 362/335, 336, 337, 338, 296, 297, 298, 299, 333, 332, 80, 83, 61

[56] References Cited

U.S. PATENT DOCUMENTS

| | | | |
|---|---|---|---|
| 2,102,975 | 12/1937 | Rolph | 240/8.3 |
| 3,283,142 | 11/1966 | Freeman | 362/298 |
| 3,392,277 | 7/1968 | Dawson | 362/299 |
| 4,120,018 | 10/1978 | Nagel . | |
| 4,420,800 | 12/1983 | VanHorn | 362/297 |
| 4,484,254 | 11/1984 | Pucket et al. | 362/338 |

FOREIGN PATENT DOCUMENTS

| | | |
|---|---|---|
| 1079565 | 4/1960 | Fed. Rep. of Germany . |
| 2940866 | 4/1981 | Fed. Rep. of Germany . |
| 3035005 | 4/1982 | Fed. Rep. of Germany . |
| 799964 | 4/1936 | France . |
| 2207473 | 6/1974 | France . |
| 2501828 | 3/1981 | France . |

*Primary Examiner*—Ira S. Lazarus
*Assistant Examiner*—Sue Hagarman

[57] ABSTRACT

An indicator light for a motor vehicle, the light being of the type comprising a substantially point light source (10) and a flat closure glass (20), situated in front of the source, together with beam-forming means for forming a beam of light rays (x'x) propagating along a given general emission direction of the light, said beam-forming means comprising: a generally flat or concave mirror (30) disposed behind the light source and comprising a set of stepped reflecting zones (32, 32, 33) inclined to reflect light rays from the source towards the glass; and a set of deflector zones (201, 202, 203) which are generally in the form of concentric rings on the glass, each zone being formed by a set of narrow prisms all having the same profile within each zone, said profile being designed as a function of the average direction respectively of direct rays and of reflected rays received by said zone.

11 Claims, 4 Drawing Sheets

SHALLOW INDICATOR LIGHT FOR A MOTOR VEHICLE

FIELD OF THE INVENTION

The present invention relates in general to motor vehicle indicator lights, and in particular to lights which are relatively flat or "shallow" in depth. The term "indicator" light is used herein as a general term to cover vehicle lights that are provided for signalling, e.g. side lights, brake lights, direction indicator lights, etc. . . . , as opposed to headlights which are provided to illuminate the road in front of the vehicle.

BACKGROUND OF THE INVENTION

Most vehicle indicator lights are equipped with a parabolic type reflector for forming a beam of rays running essentially parallel to an emission direction (or reference axis) of the light from a light source which is disposed close to the focus of the reflector.

However, in some cases such a reflector is omitted.

A first such case is when the lights are required to be very shallow ("flat" lights) because of lack of space for receiving deeper lights on the vehicle. The absence of such reflector results from the physical impossibility to include such a reflector in the small space allowed for the light since such reflectors are necessarily relatively deep.

Another case is when the reflector is omitted for reasons of economy, since the reflector is relatively expensive compared with the other parts of the light. In this case the fact that the light is shallow derives from the fact that the reflector has been omitted.

Finally, a shallow indicator light that does not have an internal reflector may be used for reasons of style.

Nevertheless it is still generally necessary, even without a reflector, to form a light beam which is relatively concentrated along the emission axis in order to satisfy the photometric requirements laid down by regulations.

A well-known solution to this problem consists in forming a beam of essentially parallel light rays by means of a Fresnel lens disposed in front of the lamp and incorporated either in its closure glass, or else separated therefrom. Such a Fresnel lens is conventionally constituted by a succession of nested rings each of which is in the form of a portion of spherical lens focused on the filament of the lamp which constitutes the light source in the light.

In the above-defined context, such Fresnel lenses are advantageous in that they enable an indicator light beam to be formed using a light whose depth is very small, for example a few centimeters.

Nevertheless, Fresnel lenses suffer from several drawbacks: they take a relatively long time to manufacture and are therefore relatively expensive, since the master pattern for making the mold used for forming the glass comprises a large number of different spherical surfaces each of which must be defined accurately. This accuracy requires that each ring should be relatively wide. As a result, the beam obtained has a clearly perceptible succession of light zones corresponding to the ring-shaped spherical refraction surfaces, and dark zones corresponding to the steps between these surfaces. This constitutes a second drawback. In addition to the unsightly appearance of the beam, there may be further difficulties in meeting the photometric requirements with any given beam.

The present Applicant's published French patent application No. 2 501 828 describes an indicator light of the above type in which the recovered light flux is increased by providing a reflector device behind the lamp and operating on the catadioptric principle to return the rays reflected by the lamp back through 180° towards the lamp.

However, this device merely creates a virtual light source which is practically superposed on the real light source and as a result the above-mentioned optical defect remains.

The present invention seeks to mitigate these drawbacks of the prior art by proposing a shallow indicator light which is easy and cheap to make while nevertheless providing a light beam which is satisfactory from the points of view both of optics and of appearance.

SUMMARY OF THE INVENTION

The present invention provides an indicator light for a motor vehicle, the light being of the type comprising a substantially point light source and a flat closure glass situated in front of the source, together with beam-forming means for forming a beam of light rays propagating along a given general emission direction of the light, said beam-forming means comprising:

a set of deflector zones which are generally in the form of concentric rings on the glass, each zone being formed by a set of narrow prisms all having the same profile within each zone; and a generally flat or concave mirror disposed behind the light source and comprising a set of reflecting zones homologous to the deflecting zones of the glass, each reflecting zone comprising a set of sloping rings inclined to reflect light rays from the source towards a homologous deflecting zone of the glass, with the average direction of said reflected rays being different from the average direction of the light rays emitted directly from the source to the same deflecting zone, and with the profile of the prisms in each deflecting zone being designed as a function of said two average directions in order to deflect said light rays so that they propagate in a direction close to said general emission direction.

BRIEF DESCRIPTION OF THE DRAWINGS

Preferred embodiments of the invention are described by way of example with reference to the accompanying drawings, in which.

DESCRIPTION OF PREFERRED EMBODIMENTS

Figure 1:
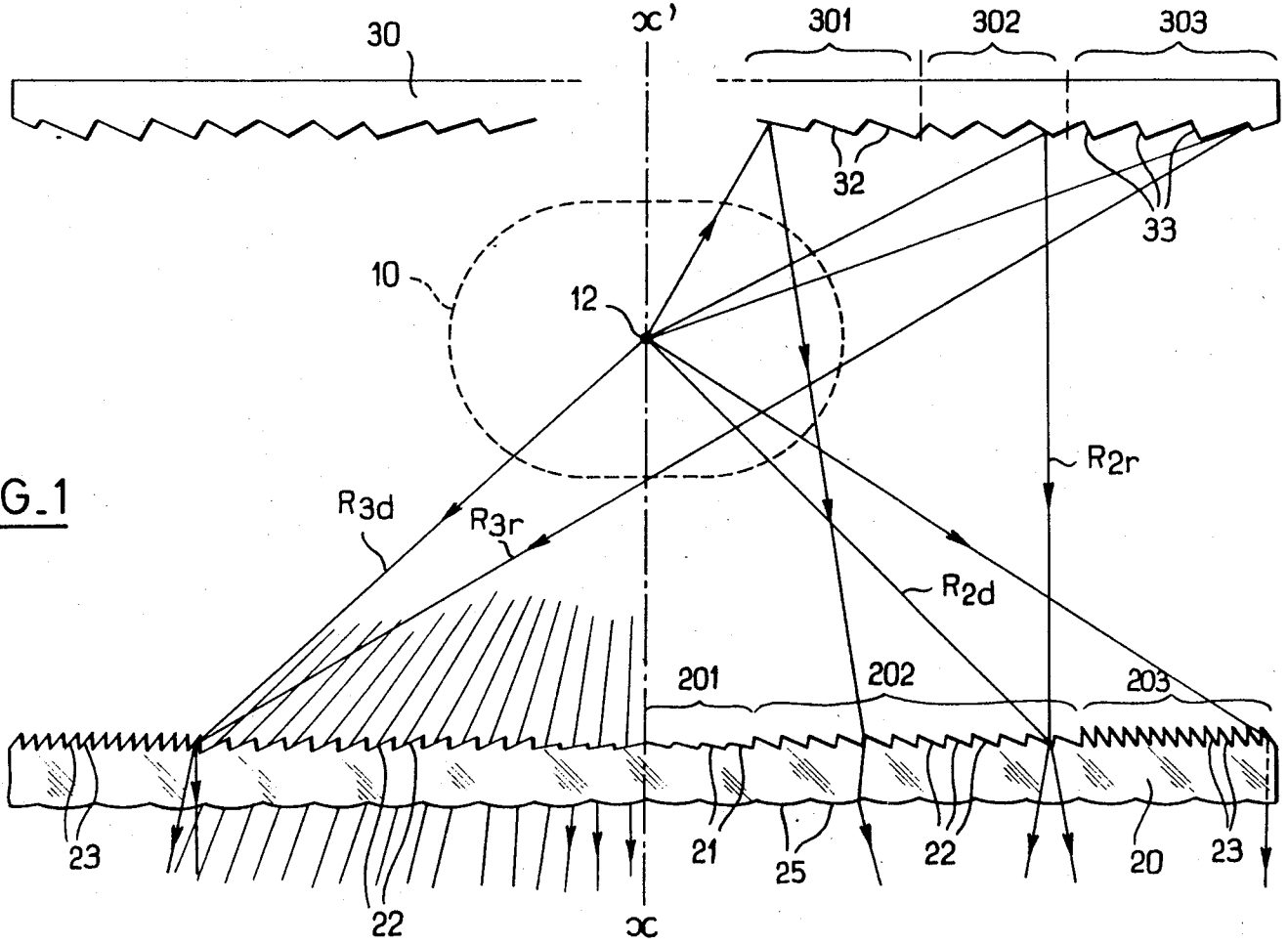
FIG. 1 is a horizontal section through an indicator light in accordance with the present invention.

FIG. 1 shows an indicator light for a motor vehicle, e.g. a side light, and this light is characterized by being extremely shallow. This type of light makes it possible to solve problems related to fitting the light in the vehicle.

The light has an axis referenced x'x and includes a lamp 10 provided with a filament 12 which will be assumed as a first approximation to be a point source of light, the light further includes a flat base or support 30 defining the back of the light and provided with a reflecting surface, and finally it has a closure glass 20 which is also generally flat in shape.

Since the light is a shallow light, it has no parabolic reflector type of beam concentrator, and as a result the source 10, the reflecting back 30, and the glass 20 are designed, in accordance with the invention, to co-operate in such a manner as to form a beam which is relatively concentrated along the reference axis x'x of the light and to satisfy various photometric requirements.

The light flux emitted by the filament 12 may be roughly divided into two portions: the first portion is constituted by those rays which encounter the glass 20 directly, and which are identified throughout the following description by the index "d"; and the other portion is constituted by the rays which are directed towards the back of the light (towards the top of FIG. 1), and which are reflected by the mirror 30 so as to return towards determined regions of the glass 20, as described below. This type of ray is identified below by means of the index "r".

In the present example, the glass 20 comprises a succession of prisms for deflecting light rays by refraction or total reflection, and which operate as a Fresnel lens.

In this first embodiment of the invention, these prisms are disposed in ring shaped zones (apart from the central zone which is circular) which zones are essentially concentric. Each zone is constituted by a single narrow groove which extends in a spiral over the inside plane surface of the glass.

More precisely, a first zone 201 of the glass 20 is constituted by a first groove 21 leaving the center of the glass 20 directly over the filament 12, this groove has a V-shaped profile which is designed so that the light rays arriving in this zone from the filament 12 and from the mirror 30 are deflected in general along a direction which is parallel to the above-mentioned axis x'x.

It may be observed here that a complementary optical effect takes place firstly because of the fact that the profile of the groove 21 remains identical over the entire zone under consideration (i.e. said zone does not have a well-defined focus), and secondly because of the fact that the rays arriving at said zone do not arrive, overall, from a well-defined source. Thus, it is possible to satisfy both the specified photometric requirements and to obtain a generally uniform light beam in which there is no visible alternation between dark zones and bright zones.

The terminology used throughout this description and in the claims is now explained: even when each zone is constituted by a single groove as described above, in order to facilitate understanding, it is assumed that this groove defines a set of successive juxtaposed prisms. The groove and the associated prisms are designated in each zone by the same reference numeral.

A second zone 202 which is approximately in the form of a concentric ring around the first zone 201 is constituted by the spiral development of a second groove 22 having a V-shaped profile which is different from the profile of the first groove, said profile being such that the direct and the reflected light rays are deflected as shown so as to extend, on average, parallel to the axis Ox.

As mentioned, the prisms 21 and 22 of the zones 201 and 202 operate by refracting the incident rays, and this is made possible by the fact that the inclination of the rays relative to the glass remains reasonable throughout these zones.

Finally, the closure glass 20 includes a third zone 203 which is also approximately in the form of a ring and which is defined by the spiral development of a third groove 23 whose V-shaped profile is different from that of the first two zones and is designed in this case to deflect light rays such as $R_{3d}$ coming from the filament 12 and $R_{3r}$ coming from the mirror 30 by total internal reflection on its inclined face, as shown. This procedure requires a deeper groove 23 whose active face is at a much steeper slope relative to the plane of the glass than are the active faces of the grooves 21 and 22.

Figure 2:
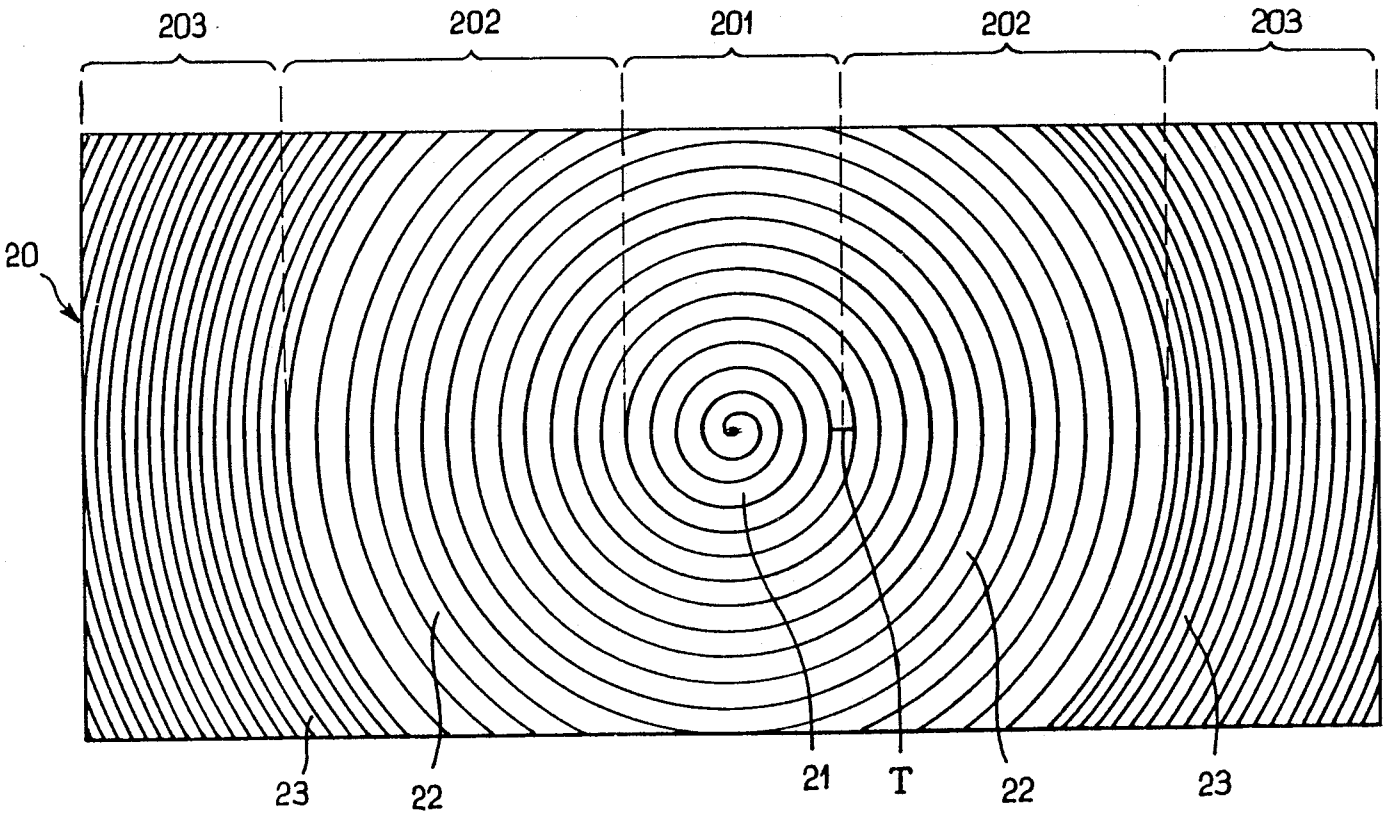
FIG. 2 is an overall front view of the glass of the FIG. 1 light.

Although the term "ring" has been used above for defining the shapes of the zones 202 and 203, it must naturally be understood that the real shapes of these zones is the result of full rings intersecting the edges of the closure glass, as shown in FIG. 2. In this respect, the spiral shape of the successive prisms in the zone 203 is not perceptible (as shown) because of the narrowness of the prisms and because of their considerable distance from the center of the glass 20.

In addition, the closure glass 20 has a set of beads 25 on its outside surface for the purpose of performing a small amount of multidirectional redistribution of the light rays so as to give the beam the desired uniformity, thereby compensating possible defects in illumination due to the rays deflected by the spiral prisms about the reference axis x'x being not exactly parallel, and thereby enabling the beam to satisfy photometric specifications. Naturally, these distribution components could be given any other appropriate shape, and in particular they could be in the form of slightly bulging vertical stripes.

As mentioned above, the main advantages of the present invention come from the fact that successive grooves are of extremely narrow width compared with the rings of an ordinary Fresnel lens, and this is related to the fact that prisms having the same profile may be used in each zone. The major advantage lies in the rings of light and shade which appear at any given observation point in the illuminated field overlap and become imperceptible, thereby giving uniform illumination.

For example, the grooves in the various zones may be between 0.2 mm and 2 mm wide.

In order to achieve these narrow widths, the glass 20 is preferably made by injection molding, and the method for making the FIG. 2 glass consists in cutting the face of the master pattern from which the mold is to be made and which corresponds to the inside face of the glass, by means of suitably shaped cutting tools, with each tool being suitable for forming the spiral groove defining one of the zones. The spirals are advantageously formed by combining rotation of the pattern with translation of the tool.

As a result, it is very easy to make the desired number of deflector zones, each of which is constituted by a single groove forming a plurality of prisms whose shape corresponds, on average, to their position relative to the filament of the lamp and the direction of the rays reflected from the back of the light.

As mentioned briefly above, an indicator light in accordance with the present invention also includes a reflector-forming base 30 which is generally flat in shape and which is situated behind the lamp 10 and which extends parallel to the glass 20. This reflector 30 constitutes a collector for the light flux emitted rearwardly by the filament 12 of the lamp and it is designed so that by the time they reach the glass, the direct rays emitted from the filament and the reflected rays passing via the reflector complement each other to some extent.

The reflector comprises a set of reflecting surfaces in the form of concentric rings.

The widths of these rings may be considerably greater than the grooves of the glass since, unlike the grooves, they do not give rise to a penumbra effect in the light beam leaving the glass. In this case, the rings are about 2 mm wide and are distributed in three zones 301, 302, 303 which are generally ring shaped, with the zones 301 and 302 corresponding approximately to the zone 202 of the glass 20, and with the zone 303 corresponding to the zone 203.

The shapes of the rings define reflecting surfaces at a relatively gentle slope interconnected by nonreflecting steps at a relatively steep slope. In any given zone, the angle between the reflecting surface and the plane of the mirror 30 is advantageously the same for all of the rings.

More precisely, the rings 31 and 32 in respective zones 301 and 302 are designed to reflect the light rays emitted towards them from the filament 12 towards the zone 202 of the glass 20, spreading said rays widely over said zone 202. To this end, the reflecting faces 31 of the zone 301 are at a relatively small slope relative to the general plane of the mirror 30 and this slope is greater in the zone 302, i.e. for rings which are further from the axis x'x.

It should be observed as mentioned briefly above, that the position of the filament 12, the orientations of reflecting rings 31 and 32, and the orientations of the prisms 22 in the glass are determined relative to one another in such a manner as to ensure that on leaving the glass, rays such as $R_{2d}$ coming directly from the filament and rays such as $R_{2r}$ reflected by the mirror 30 complement each other in direction with each of these two types of ray providing about one half of the overall light flux. Thus, FIG. 1 clearly shows that the direct rays are deflected so as to be slightly divergent on leaving the glass, whereas the rays which are reflected by the mirror 30 are, in contrast, slightly convergent.

As mentioned above, the prisms in the zone 203 of the glass are designed to deflect incident rays by total internal reflection, which is required in the present configuration by the fact that rays such as $R_{3d}$ emitted by the filament towards said zone arrive at a relatively steep slope relative to the normal to a surface is the line at 90° to the surface of the glass. Consequently, the rays which are reflected by the zone 303 of the mirror towards the zone 203 of the glass in order to complement the rays $R_{3d}$ must also arrive at a relatively steep slope at said zone 203, and it is therefore inappropriate for the zone 303 of the mirror to reflect rays directly to the corresponding region of the zone 203, i.e. approximately directly forwardly parallel to the axis of the light.

Consequently, the reflecting rings 33 of the zone 303 are at a relatively steep slope relative to the general plane of the mirror so as to reflect the rays emitted by the filament to the diametrically opposite region of the zone 203 of the glass, as shown at $R_3r$. Here again, the position of the filament 12, the inclinations of the totally internally reflecting prisms 23 and the inclinations of the reflecting rings 33 are designed relative to one another so as to ensure that there is a degree of complementarity in the light flux leaving the zone 203 of the glass, with the direct rays $R_{3d}$ being slightly convergent and with the rays $R_3r$ reflected by the zone 303 of the mirror being slightly divergent, these two light fluxes being intimately mixed on leaving the glass by virtue of the beads 25.

It may also be indicated that there is no zone on the mirror 30 corresponding to the zone 201 of the glass, and this space may be reserved, for example, for the base of the lamp 10 (not shown). The geometry of the prisms in this zone is therefore designed solely as a function of the direct rays.

The geometrical values of the various prisms and reflecting rings in the FIG. 1 embodiment are given below.

| Glass | Groove Width | Prism Angle |
|---|---|---|
| zone 201 | 1 mm | 10° |
| zone 202 | 1 mm | 25° |
| zone 203 | 0.5 mm | 55° |
| **Mirror** | **Total Ring Width** | **Reflection Angle** |
| zone 301 | 2 mm | 13° |
| zone 302 | 2 mm | 30° |
| zone 303 | 2 mm | 63° |

Naturally, any other geometrical configuration could be envisaged without going beyond the scope of the invention. In particular, if it is necessary to have a more concentrated light beam in order to satisfy stricter photometric requirements, for example, the person skilled in the art will understand how to increase the number of different concentric deflector zones in the closure glass 20, and optionally the number of different ring zones on the mirror.

Figure 3:
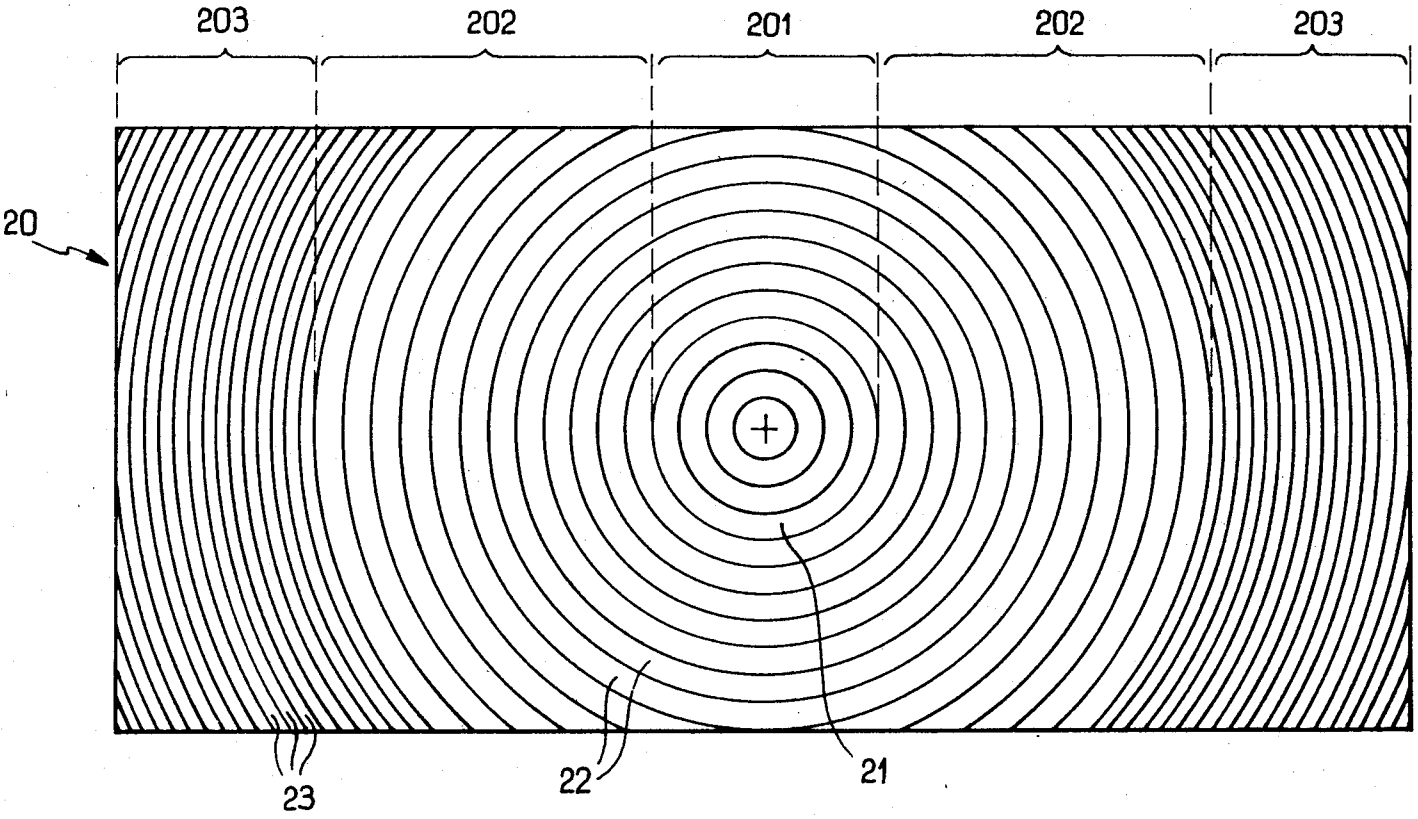
FIG. 3 is a front view of the glass of a variant light.

Further, although the above description relates to a closure glass having a single spiral groove of specific profile in each zone, which is advantageous from the manufacturing point of view, it is naturally possible for said zones to be constituted by sets of concentric circular grooves each having the same profile, as shown in accompanying FIG. 3. In this figure, the portions which correspond to portions of FIG. 2 have been given the same reference numerals.

Figure 4:
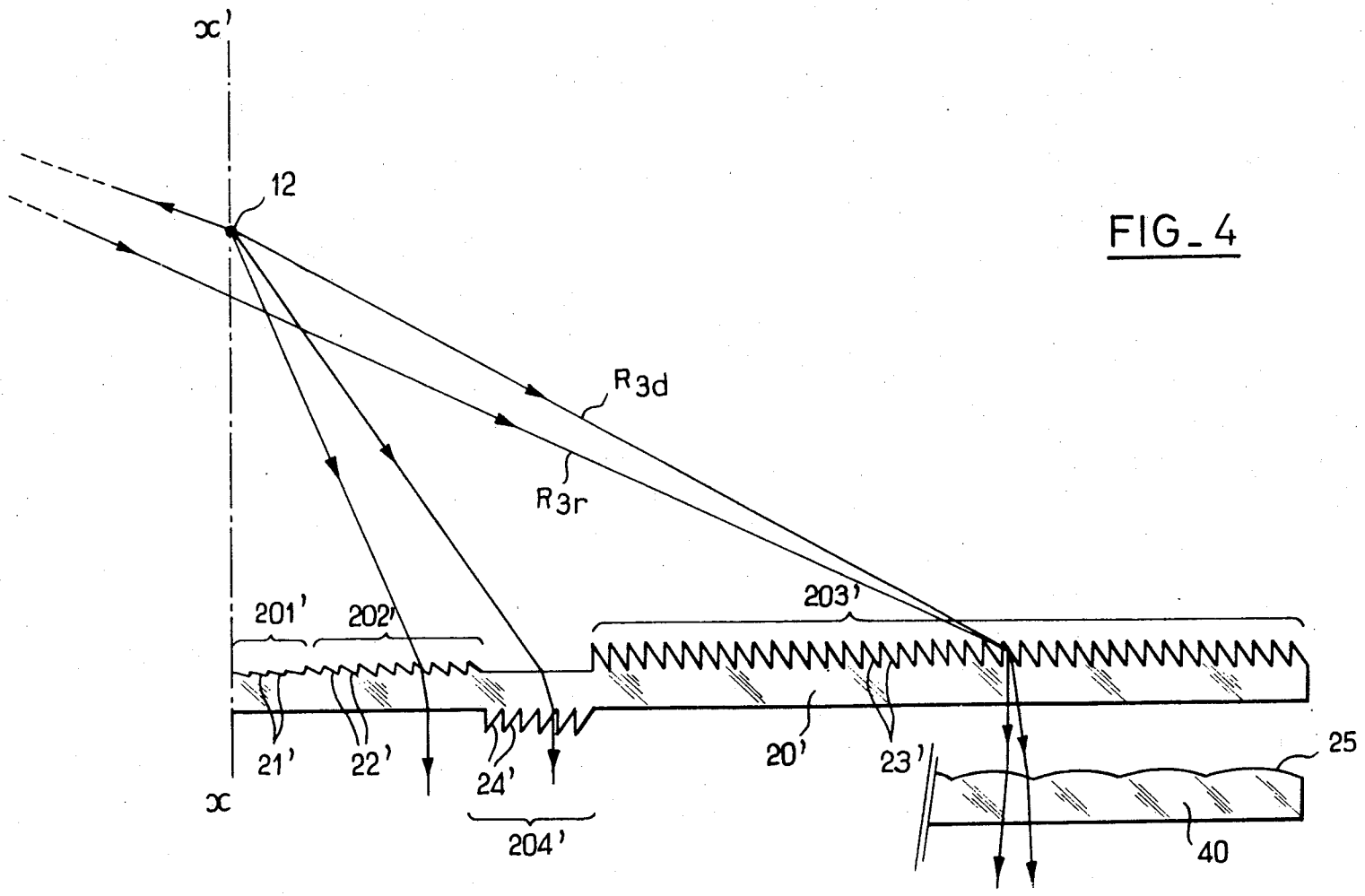
FIG. 4 is a cross-section through a portion of an indicator light in accordance with a variant embodiment of the invention.

FIG. 4 is a half cross-section through a variant embodiment of a closure glass for a shallow light in accordance with the invention. For simplification purposes, the contours of the lamp and the mirror-forming back have not been shown in this figure. It will nevertheless be understood that the mirror has its various zones distributed in a configuration which is different from that of FIG. 1 and is designed to correspond with the new glass. This glass is referenced 20' and is similar in design to the glass 20 shown in FIGS. 1 and 2. It comprises two first zones 201' and 202' each constituted by a respective single groove 21' or 22', formed on its inside surface and having a prismatic profile similar to that of the grooves 21 and 22 of the first embodiment, in order to deflect the light rays emitted by the lamp and by the mirror along a direction which is parallel, on average, with the axis x'x.

Similarly, a wide zone 203' is constituted by a single groove 23' constituting a set of prisms that operate by total internal reflection.

However, the glass 20' further includes a fourth zone 204' located between the zones 202' and 203' and having the distinctive feature of being defined by a fourth groove 24' which is for ed in the outside surface of the glass 20'. This groove defines a set of prisms that operate by refraction like the prisms 21' and 22' in order to deflect the light rays received directly from the filament 12 and the light rays reflected by the mirror 30 (not shown) along a direction which, on average, is parallel to the axis x'x. The advantage obtained by forming the groove in the outside surface of the glass resides essentially in improved light flux recovery, by virtue of the fact that the step surfaces of the prisms as "seen" by the direct incident light rays appear to be at a steeper angle, thereby occupying a smaller area compared with the active area of the same prisms. Another advantage lies in improved mixing of the direct rays and the reflected rays.

Naturally, the glass 20' is manufactured by a method which is substantially identical to that used for the glass 20, except that the master pattern from which the mold is made needs to be machined on both faces.

Naturally, the various zones of the glass may be organized as desired, and, in particular, any appropriate number of zones may be selected on the inside and/or outside surface of the glass, with the zones being of any desired width, and being defined by a number of turns of a spiral groove of given width or by a number of concentric circular grooves, with any prismatic profile being used that is appropriate for the position of the lamp filament and the configuration of the mirror rings for recovering the rearwardly directed flux.

Further, given various regulations, particularly in Europe, which forbid the provision of outwardly projecting prisms or the like on the outside surface of the glass of an optical component, a glass in accordance with the invention and provided with one or more outside grooves may, where appropriate, have an outer cover glass provided thereover in order to satisfy said regulations.

Further, the total internal reflection prisms are preferably provided in regions of the glass which are furthest from the lamp, and they are necessarily provided on the inside face of said glass.

Finally, the present invention is not limited to the embodiments described above and shown in the drawings, and the person skilled in the art will be able to make modifications while remaining within the scope of the invention.

In particular, the item referred to as the "glass" in the present description may be constituted by a backing plate or an intermediate plate in a structure which further includes an outer glass 40, which outer glass preferably has beading or stripes on its inside surface (as shown, in part, in FIG. 4).

Further, although the rear mirror is assumed to be generally flat in the above description, it could naturally be slightly concave in order to increase light flux recovery without increasing the total thickness of the light.

What is claimed:

1. An indicator light for a motor vehicle, the light being of the type comprising a substantially point light source and a flat closure glass situated in front of the source, together with beam-forming means for forming a beam of light rays propagating along a given general emission direction of the light, said beam-forming means comprising:

a set of deflector zones which are generally in the form of concentric rings on the glass, each zone being formed by a set of narrow prisms all having the same profile within each zone; and a generally flat or concave mirror disposed behind the light source and comprising a set of reflecting zones homologous to the deflecting zones of the glass, each reflecting zone comprising a set of sloping rings inclined to reflect light rays from the source towards a homologous deflecting zone of the glass, with the average direction of said reflected rays being different from the average direction of the light rays emitted directly from the source to the same deflecting zone, and with the profile of the prisms in each deflecting zone being designed as a function of said two average directions in order to deflect said light rays so that they propagate in a direction close to said general emission direction.

2. An indicator light according to claim 1, wherein the reflecting rings within any one mirror zone all have the same inclination.

3. An indicator light according to claim 1, wherein the prisms in any one zone of the glass are all constituted by a single spiral groove.

4. An indicator light according to claim 1, wherein the prisms in any one zone of the glass are constituted by a set of concentric circular grooves.

5. An indicator light according to claim 1, wherein at least one outer zone of the glass furthest from the light source has prisms which operate by total internal reflection with respect to rays emitted by the source, while the prisms in the, or each, other zone in the glass operate by refraction.

6. An indicator light according to claim 5, wherein the mirror has a set of rings in an outer zone which reflect the light rays emitted by the source towards a diametrically opposite region of said outer zone(s) of the glass having prisms that operate by total internal reflection.

7. An indicator light according to claim 6, wherein said outer zone of the mirror furthest from the light source corresponds to the outer zone(s) of the glass including totally internally reflecting prisms.

8. An indicator light according to claim 1, wherein at least one zone of the glass is constituted by prisms formed on the outside surface of said glass.

9. An indicator light according to claim 1, further including means for dispersing the beam.

10. An indicator light according to claim 1, wherein the widths of the prisms lie between about 0.2 mm and 2 mm.

11. An indicator light according to claim 1, wherein the mirror also constitutes the housing of the light.

* * * * *